US007685654B1

(12) United States Patent
Jones

(10) Patent No.: US 7,685,654 B1
(45) Date of Patent: Mar. 30, 2010

(54) DISPOSABLE SHAVING TRAY, SINK AND DRAIN PROTECTOR, AND RUBBISH COLLECTOR

(76) Inventor: Rahman Levi Jones, 113 Fairbanks Dr., Garland, TX (US) 75043

( * ) Notice: Subject to any disclaimer, the term of this patent is extended or adjusted under 35 U.S.C. 154(b) by 959 days.

(21) Appl. No.: 11/201,888

(22) Filed: Aug. 11, 2005

(51) Int. Cl.
*A47K 1/06* (2006.01)

(52) U.S. Cl. ..... 4/655; 4/654; 4/657; 4/245.6

(58) Field of Classification Search ..... 4/655, 4/654, 657, 659, 245.6, 245.7
See application file for complete search history.

(56) References Cited

U.S. PATENT DOCUMENTS

| | | | | | |
|---|---|---|---|---|---|
| 1,297,613 | A | * | 3/1919 | Van Dunker | 4/655 |
| 2,817,851 | A | * | 12/1957 | Barnwell | 4/655 |
| 3,988,784 | A | | 11/1976 | Reedy | 4/1 |
| 4,305,166 | A | | 12/1981 | Rose | 4/631 |
| 4,811,982 | A | | 3/1989 | Carlyle | 296/95.1 |
| 4,979,237 | A | | 12/1990 | Hazar et al. | 4/242 |
| 5,040,252 | A | * | 8/1991 | Taggart | 4/580 |
| 5,279,007 | A | | 1/1994 | Kolada | 4/639 |
| 5,551,096 | A | | 9/1996 | Gardner | 4/245.4 |
| 5,815,855 | A | | 10/1998 | McKeehan | 4/631 |
| 5,815,856 | A | | 10/1998 | Dore | 4/657 |
| 5,991,942 | A | | 11/1999 | Neal | 4/655 |
| D449,875 | S | | 10/2001 | Fludd-Robinson et al. | D23/308 |
| 6,838,150 | B2 | | 1/2005 | Mazurek et al. | 428/141 |

* cited by examiner

*Primary Examiner*—Khoa D Huynh
(74) *Attorney, Agent, or Firm*—Merchant & Gould P.C.

(57) ABSTRACT

A disposable sanitary protector for sink basins is provided in the form of a generally rectangular cover with two non-parallel low-tack adhesive strips on the underside, one of each strip being on the underside of the cover near the left and right edges. The non-parallel low-tack adhesive strips increase the probability of engaging the rim of sinks with either a curved or linear shape at the sides of the sink. An optional perforated slit is provided to allow a portal for the faucet assembly to protrude. A second differently sized backup slit is provided in the event the first slit tears. The cover is made of fabric, paper, plastic or a like material.

11 Claims, 3 Drawing Sheets

DISPOSABLE SHAVING TRAY, SINK AND DRAIN PROTECTOR, AND RUBBISH COLLECTOR

PRIORITY DATE CLAIMED

No priority date is claimed for this patent application.

BACKGROUND OF THE INVENTION

1. Field of the Invention

The present invention relates to a sanitary product and more particularly relates to a disposable, personal protector which covers the basin portion of a sink, particularly sinks in public toilets such as those in airplanes, trains, buses, and related forms of public transportation.

2. Description of Prior Art

Public health concerns have resulted in many public toilet facilities in restaurants, airports, aircraft and similar places providing toilet seat covers. These toilet seat covers generally consist of a sheet of paper with a partially cut-out center section. When placed in use, the center section must be torn away or partially separated from the rest of the cover and the cover is then placed on the toilet seat. No such covers are contemplated or provided by airlines on extended flights such as international travel where sinks are likely to be used for shaving with either conventional or electric razors. When used as such, often times the user fails to adequately clean the sink afterwards. Conventional paper towels when used to cover a sink are inadequate as the paper often falls into the basin and/or is wetted when it touches the drain area where water often is present. Plain paper and plastic covers are inadequate in a number of other respects in that they are often flimsy with no means for attachment to rim of the sink thereby interfering with their intended use. Also, since these prior art covers are simply placed over the sink, they are easily displaced when rubbish is dropped onto them or simply slip from the rim of the sink during use. An example of this prior art structure for which this invention is an improvement is recited in U.S. Pat. No. 5,991,942 entitled "Disposable Sink and Drain Protector and Rubbish Protector" that issued to Neal on Nov. 14, 1999.

U.S. Pat. No. 4,979,237 entitled "Disposable Sanitary Protector Cover for Toilet" that issued to Hazar et al. On Dec. 25, 1990 teaches an improvement for a disposable toilet seat cover wherein a retainer member is used. The retainer member may be in the form of a flange or tab to engage the inner edge of the seat to temporarily secure the protector in place during use and/or may be a frictional material such as latex or a low-tack adhesive.

In the known prior art, there are disposable head rest covers, disposable medical examination hand covers or gloves, disposable bandages to cover wounds, disposable toilet seat covers adapted with releasable adhesive, and disposable floor mats for automobiles.

As evinced by the foregoing, the prior art covers are generally inadequate and ineffective for their intended purpose nor do they intimate the novel structural approach for detachably affixing sink covers to the rim of a sink presented herein. Accordingly, there exists a need for an effective sanitary, water-resistant protector for sinks, particularly public sinks which protectors are disposable and will remain in proper position above the sink during use.

OBJECTS OF THE INVENTION

It is a general object of the invention to provide an improved disposable sink and drain protector and rubbish collector, or sink cover that functions as a shaving tray and that avoids the disadvantages of prior covers while affording additional structural and operating advantages.

An important object of the invention is the provision of a releasable pressure-sensitive attachment means using a low-tack adhesive in a particular geometry that effectively allows the cover to be attached to rims of both rectangular and rounded sinks.

Another important object of the invention is the provision of a primary perforated slit that allows an edge of the cover to be partially secured via the faucet assembly.

Yet another important object of the invention is the provision of a backup or secondary perforated slit for use in the event the primary slit is damaged.

In connection with the foregoing novelties, another object of the invention is the provision of a non-parallel orientation of the adhesive means so that the probability of engaging the rim at some congruent segment on the left and right sides of the sink is substantially increased.

Another object of the invention is the provision of a sink cover that prevents hair from falling into the basin of a sink when shaving or grooming, thereby obviating the need for wiping out the basin to remove hair which might otherwise clog the drain.

Still another object of the invention is the provision of a sink cover that efficiently cost-effectively utilizes removable pressure-sensitive adhesive in a minimal area in the structure described, which is of relatively simple and economical construction and readily manufactured in a folded scheme for volume use out of a dispenser.

SUMMARY OF THE INVENTION

Briefly, the present invention comprehends a disposable sanitary protector for basins of sinks in the form of a cover which is generally rectangular in shape with two non-parallel low-tack adhesive strips, one each at the left and right undersides of the cover. The non-parallel low-tack adhesive strips are selected to increase the probability of engaging the rim of sinks with either curved or linear rims at the sides of the sink. An optional perforated slit is used to allow a portal for the faucet assembly at the back of the sink. A second differently sized backup slit is provided in the event the first slit tears completely and becomes unusable. The cover functions as a shaving tray and generally conforms to the outer periphery of the sink and overhangs the rim in some sink designs. The cover is fabricated from a suitable flexible or semi-rigid material and may be fabric, paper or plastic. In addition, each strip on the underside of the cover is a low-tack adhesive.

In other embodiments, the protector may be provided as part of a system for use in public toilet facilities, which includes a dispenser for vending or dispensing the cover and a suitable waste container for disposal of the covers after use. The covers may also be provided in a folded compact form in a package, which may be carried by the individual and which can be used to receive the used cover at the time of disposal.

This new and novel invention provides a detachable adhesively mounted cover for a sink that forms a rubbish protector that in the plastic version can even be used in the kitchen as a germ and bacterial shield to readily dispose of vegetable or meat cuttings.

BRIEF DESCRIPTION OF THE DRAWINGS

The above objects and other features, aspects, and advantages of the present invention will become better understood with regard to the following description, appended claims, and accompanying drawings wherein:

DESCRIPTION OF THE PREFERRED EMBODIMENT

Figure 1:
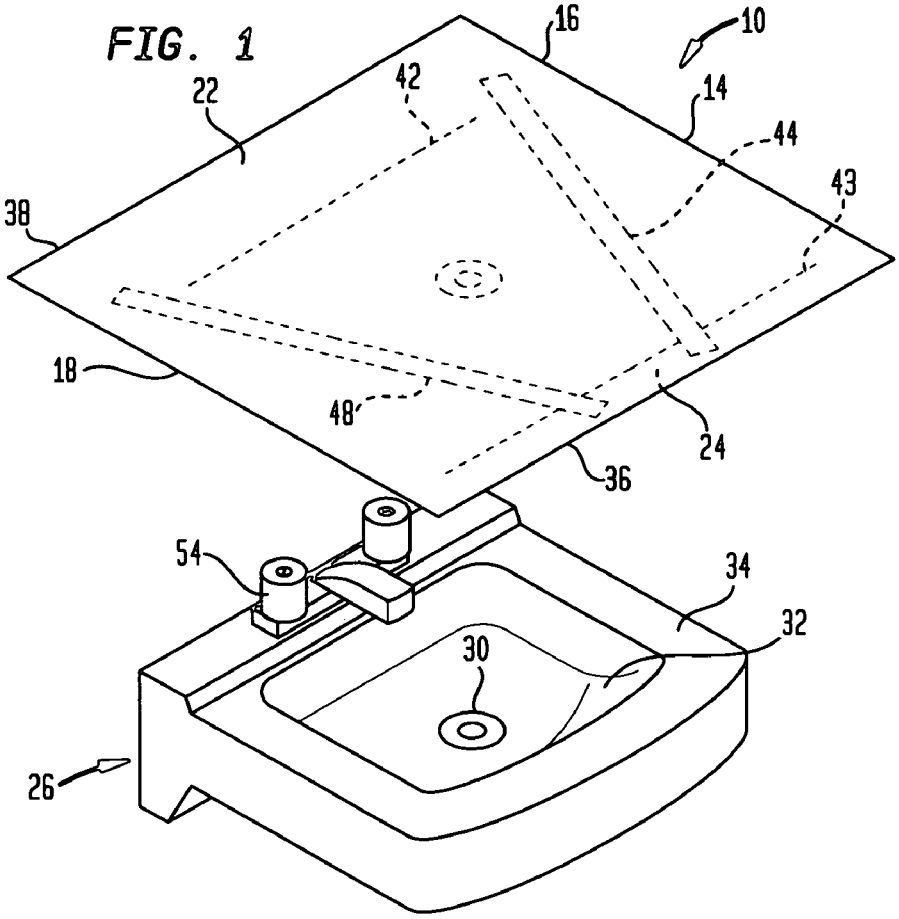
FIG. 1 is an elevational exploded view of a sink and basin assembly shown below a flexible disposable cover according to the present invention.
Figure 2:
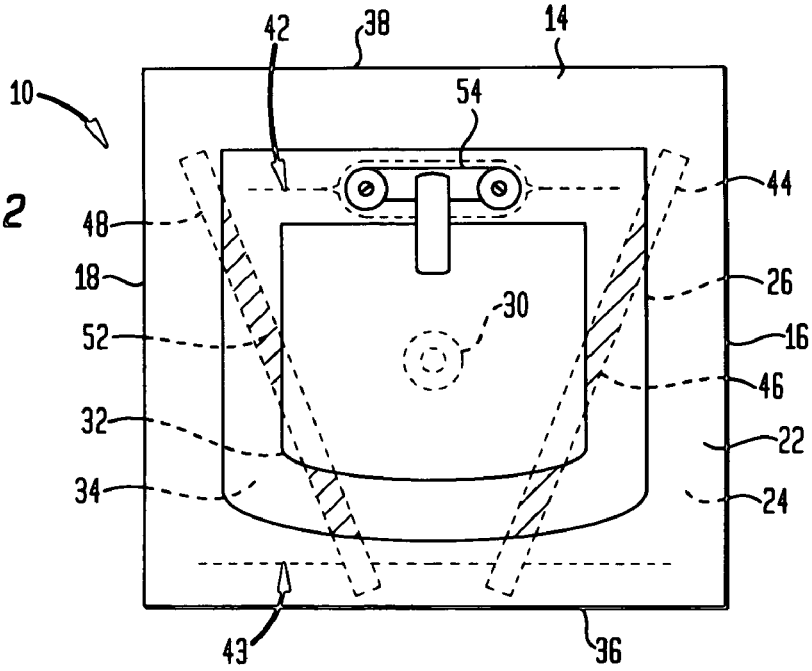
FIG. 2 is a plan view of the cover with a slit opened around a faucet attached to the sink.

In accordance with one aspect of the invention, there is provided a method of using a novel disposable sink and drain protector 10 as shown in FIGS. 1 and 2. The method includes the step of providing the disposable sink and drain protector 10. The protector 10, which can serve as a shaving tray, comprises a flexible planar sheet 14 having a right edge 16 and a left edge 18, a top surface 22 and a bottom surface 24 and sized to cover a sink 26 with a drain 30, basin 32 and its surrounding rim 34. The planar sheet 14 further has a proximal edge 36 and a distal edge 38. A first perforated slit 42 is located near the distal edge 38. A backup or second perforated slit 43 is located near the proximal edge 36.

Shown also in FIG. 1 is a first attachment means 44 for releasably affixing the planar sheet 14 to a first segment 46 (shown in FIG. 2) of the rim 34 and a second attachment means 48 for releasably affixing the planar sheet 14 to a second segment 52 of the rim 34.

Further shown in FIG. 2, the first perforated slit 42 is broken and opened. The first slit 42 is then placed over a faucet 54 shown attached to the sink 26. Near the right edge 16 of the planar sheet 14 the bottom 24 of the planar sheet 14 is releasably affixed to the rim 34 of the sink 26 at a first segment 46 using the first attachment means 44, a low tack adhesive strip. The first segment 46 is an intersection of a congruent part of the low tack adhesive strip or means 44 and the rim 34. Near the left edge 18 of the bottom surface 24 of the planar sheet 14 another low tack adhesive strip or second attachment means 48, forms a second segment 52 at its intersection with a congruent part of the rim 34 of the sink 26.

Figure 4:
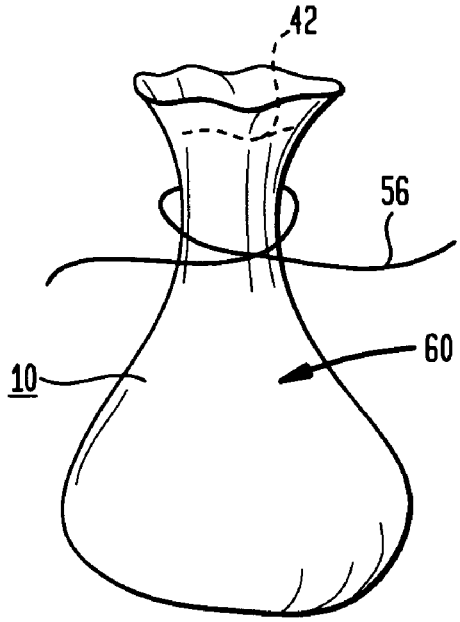

The novel disposable sink and drain protector 10 shown in FIG. 2 is used by depositing shaving or make-up rubbish (not shown) on the planar sheet 14. To hold up to this deposit the sheet 14 is made of a suitably stiff paper or stiff plastic material. The protector 10 is gathered together above the basin 32 of sink 26 using the edges 16 and 18 of the planar sheet 14 by causing the low tack adhesive strips or attachment means 44 and 48 to release from the rim 34 and then tying off the sheet 14 near all of the gathered edges 16, 18, 36, and 38, but below the perforated slits 42 and 43. A tie 56 such as a string, coated wire, or adhesive tape is used form a rubbish collector 60 for disposal as shown in FIG. 4.

Figure 3A:
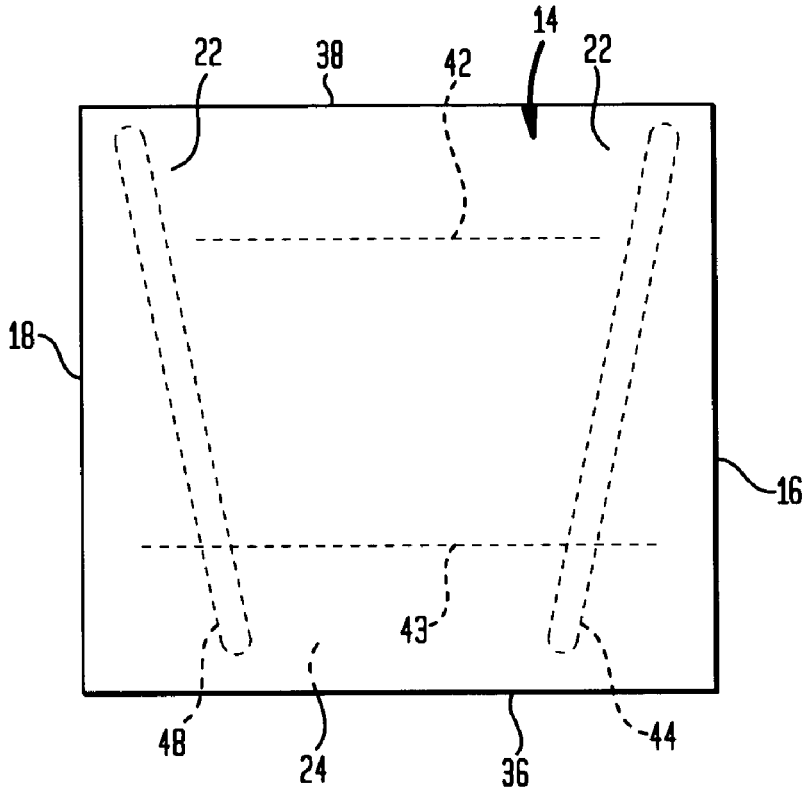
FIG. 3*a* is a top plan view of the cover of the novel invention.
Figure 3B:
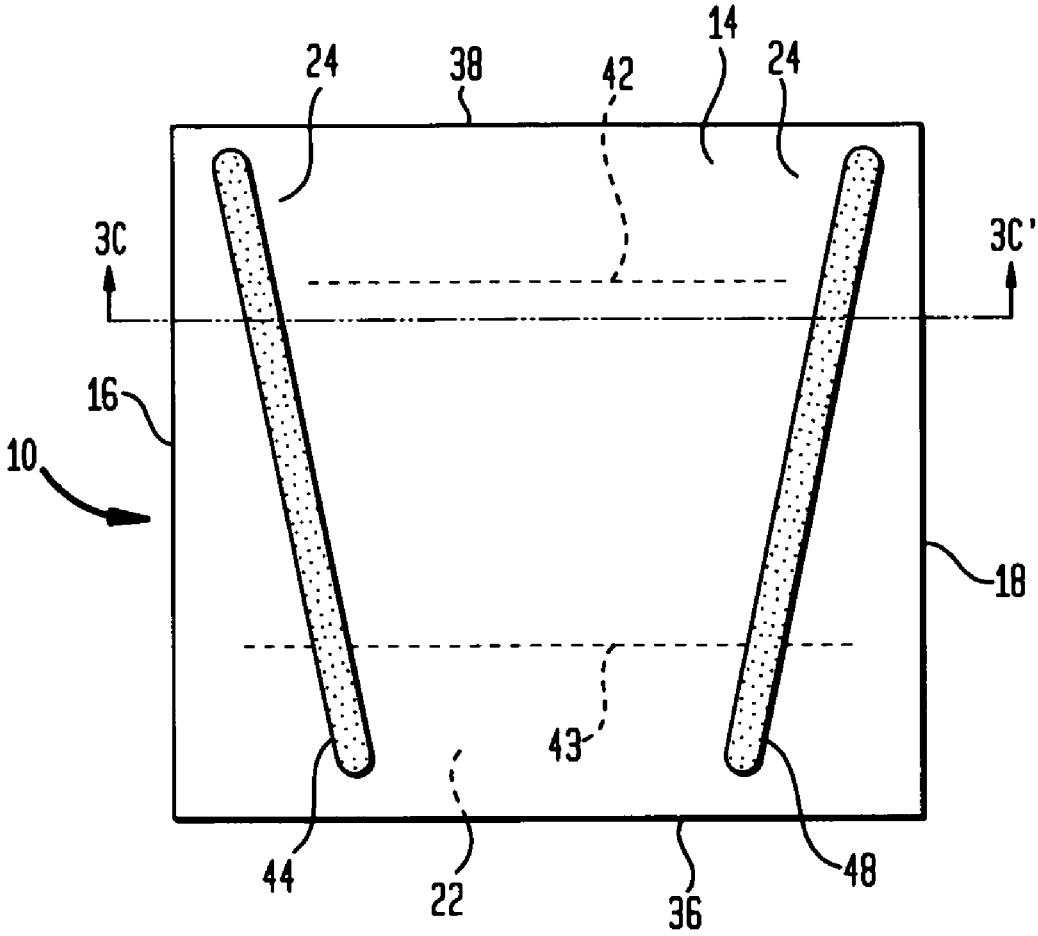
FIG. 3*b* is a bottom plan view of the cover of the novel invention.
Figure 3C:
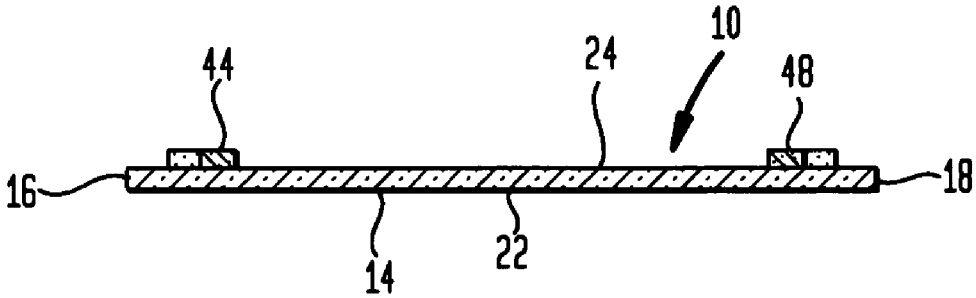
FIG. 3*c* is a cross-sectional view of the cover shown in FIG. 3*b* along the plane 3*c*-3*c*'; and, FIG. 4 is an elevational view of the cover formed into a sac and tied with a tie for disposal.

Shown in FIGS. 3*a*, 3*b*, and 3*c* the novel and improved disposable sink and drain protector and rubbish protector 10 is translucent or transparent. The releasably attaching means 44 and 48 are strips of a transparent or translucent low-tack adhesive that is also pressure-sensitive. For example, such a pressure-sensitive adhesive is disclosed in U.S. Pat. No. 6,838,150 to Mazurek et al that issued on Jan. 4, 2005 entitled, "Pressure-Sensitive Adhesives Having Microstructured Surfaces" and in the publication dated May 1, 2003. The text and teachings of this patent and the publication are incorporated herein by reference. Thus, the protector 10 is attached to the rim 34 of the sink 26 shown in FIG. 2 by pressing along the means 44 and 48 where each engages the rim 34.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

PARTS LIST protector 10
sheet 14
right edge 16
left edge 18
top surface 22
bottom surface 24
sink 26
drain 30
basin 32
rim 34
proximal edge 36
distal edge 38
first perforated slit 42
second perforated slit 43
first attachment means 44
first segment 46
second attachment means 48
second segment 52
faucet 54
tie 56
rubbish collector 60

What is claimed is:

1. A method for protecting a sink having a drain, the sink having a basin with surrounding rim, a faucet, and a drain inside the sink comprising the steps of:

(a) providing a disposable sink and drain protector and rubbish collector comprising a semi-rigid planar sheet having a right edge and a left edge, a top surface and a bottom surface and sized to cover at least the sink and the surrounding rim, the planar sheet further having a proximal edge and a distal edge, wherein the planar sheet consists only of a first perforatable slit located near the proximal edge and a second perforatable slit located near the distal edge, the second perforatable slit being oriented a distance away from the distal edge and parallel to the first perforatable slit, wherein the proximal edge extends a straight line distance beyond the rim of the sink such that the second perforatable slit is located beyond the rim of the sink, and wherein the second perforatable slit comprises a backup slit when the second perforatable slit is broken;

(b) providing an elongated first attachment means for releasably affixing the planar sheet to only a first portion of the right edge of the rim and a first portion of a proximal edge of the rim;

(c) releasably affixing the first attachment means to the rim;

(d) obliquely orienting the first attachment means in relationship to the right edge;

(e) transversely orienting the first attachment means in relationship to the rim such that the first attachment means is affixed to only the first portion of the right edge of the rim and the first portion of the proximal edge of the rim, thereby being leaving at least a second portion of the right edge of the rim and a second portion of the proximal edge uncovered with respect to the first attachment means;

(f) providing an elongated second attachment means for releasably affixing the planar sheet to only a first portion of the left edge of the rim and a third portion of the proximal edge of the rim;

(g) releasably affixing the elongated second attachment means obliquely to the left edge of the rim;

(h) obliquely orienting the second attachment means in relationship to the left edge such that the second attachment means is affixed to only the first portion of the left edge of the rim and the third portion of the proximal edge of the rim, thereby leaving at least a second portion of the left edge of the rim and the second portion of the proximal edge uncovered with respect to the second attachment means;

(i) breaking the first perforatable slit to form a first slit;

(j) placing the first slit over the faucet;

(k) releasably affixing the right side of the bottom surface of the planar sheet to the rim of the sink using the first attachment means for releasably affixing the planar sheet to the rim;

(l) releasably affixing the left side of the bottom surface of the planar sheet to the rim of the sink wherein the second attachment means is oblique to the rim;

(m) rotating the protector 180 degrees;

(n) breaking the second perforatable slit to form the backup slit; and (o) placing the backup slit over the faucet upon destruction of the first slit such that the first slit is unusable.

2. The method according to claim 1 further comprising the steps of:

depositing rubbish on the planar sheet; and gathering together the edges of the planar sheet and tying off the sheet near the gathered edges below a perforated slit whereby the basin of the sink is kept clean and a rubbish collector for disposal is formed of the tied-off and gathered planar sheet and the drain is prevented from becoming clogged.

3. A method for providing an improved disposable sink and drain protector for a sink having a rim, faucet, and drain inside a basin of the sink comprising extending a semi-rigid planar sheet having a bottom; sizing the planar sheet to cover the sink substantially beyond the surrounding rim, further providing the planar sheet with a proximal edge and a distal edge; the planar sheet consisting only of a first perforatable slit and a second perforatable slit, the first perforatable slit located near the distal edge and the second perforatable slit located a distance from the first perforatable slit near the proximal edge and beyond the surrounding rim, where the second perforatable slit is parallel to the first perforatable slit; perforating the first perforatable slit in the planar sheet; providing an elongated rectangular area of a tacky, releasable adhesive; orienting the rectangular area non-parallel and non-orthogonal to any edge; releasably affixing the elongated rectangular area for releasably affixing a part of the bottom of the planar sheet to a part of the rim; rotating the planar sheet 180 degrees; and perforating the second perforatable slit for placement over the faucet upon destruction of the first perforatable slit such that the first perforatable slit is unusable.

4. The method according to claim 3 further comprising the step of affixing an intersecting means for enabling the elongated rectangular area to be obliquely affixed on a section of the rim.

5. The method according to claim 3 further comprising the step of:

coating the planar sheet wherein said sheet has a water-resistant coating.

6. The method according to claim 5 further comprising the step of:

forming the planar sheet of plastic.

7. The method according to claim 6 further comprising the step of:

providing a tie for binding together the protector near the edges whereby a tied rubbish receptacle is formed for disposal.

8. The method according to claim 1 further comprising the step of providing a rubbish collector with a tie.

9. The method according to claim 1 further comprising the step of placing low-tack releasable adhesive on the first attachment means and the second attachment means.

10. The method according to claim 1, wherein a size associated with the second perforatable slit is greater than a size associated with the first perforatable slit.

11. The method according to claim 3, wherein a length associated with the second perforatable slit is greater than a length associated with the first perforatable slit.

* * * * *